United States Patent [19]

De Rosa

[11] 4,290,658

[45] Sep. 22, 1981

[54] DRAWER FILE CABINET

[76] Inventor: Dennis De Rosa, 267 E. Wrightwood, Glendale Heights, Ill. 60137

[21] Appl. No.: 77,750

[22] Filed: Sep. 21, 1979

[51] Int. Cl.[3] ..... B65D 5/24

[52] U.S. Cl. ..... 312/108; 229/31 FS; 312/258; 312/184

[58] Field of Search ..... 312/107, 108, 111, 184, 312/258, 259; 229/19, 37, 39, 31 FS, 34 R

[56] References Cited

U.S. PATENT DOCUMENTS

| | | | |
|---|---|---|---|
| 2,128,341 | 8/1938 | Zalkind | 229/19 |
| 2,136,184 | 11/1938 | Fellowes | 229/19 |
| 2,341,928 | 2/1944 | Leukoff | 229/31 FS |
| 2,742,221 | 4/1956 | Hickin | 229/31 FS |
| 3,957,320 | 5/1976 | Walter | 312/259 |

*Primary Examiner*—Casmir A. Nunberg
*Attorney, Agent, or Firm*—Edward C. Threedy

[57] ABSTRACT

A file cabinet and drawer each formed from a single sheet of cardboard, fiberboard, or like material with the file cabinet being formed to provide a housing for the drawer. The drawer being so formed as to have multiple layered front and rear walls and doubled panelled side walls with one of said panelled side walls providing an interior file carrier support.

2 Claims, 4 Drawing Figures

DRAWER FILE CABINET

SUMMARY OF THE INVENTION

Inexpensive file cabinets and drawers formed from cardboard, fiberboard, or like material are presently available. These file cabinets and drawers possess the characteristics of being fully collapsible into a single sheet form during shipping and/or storage.

In use it has been found that such cabinets and drawers are incapable of withstanding the bulk of material stored therein, such that during relative movement of the drawer into and out of the cabinet the front and/or rear walls thereof become ruptured, deformed, or distorted, such that they lose their functional capabilities.

It is an object of this invention to provide a cabinet and drawer, each formed from a single sheet of material in such a manner that there is created a reinforced wall portion such as the front and rear walls of the drawer capable of withstanding abuse in use.

It is also an object of this invention to provide double side walls for the drawer with one of said side walls providing a file carrier support.

DESCRIPTION

This invention will be best understood by reference to the accompanying drawing in which there is illustrated a preferred form of construction by which the objects of this invention are achieved.

Figure 4:
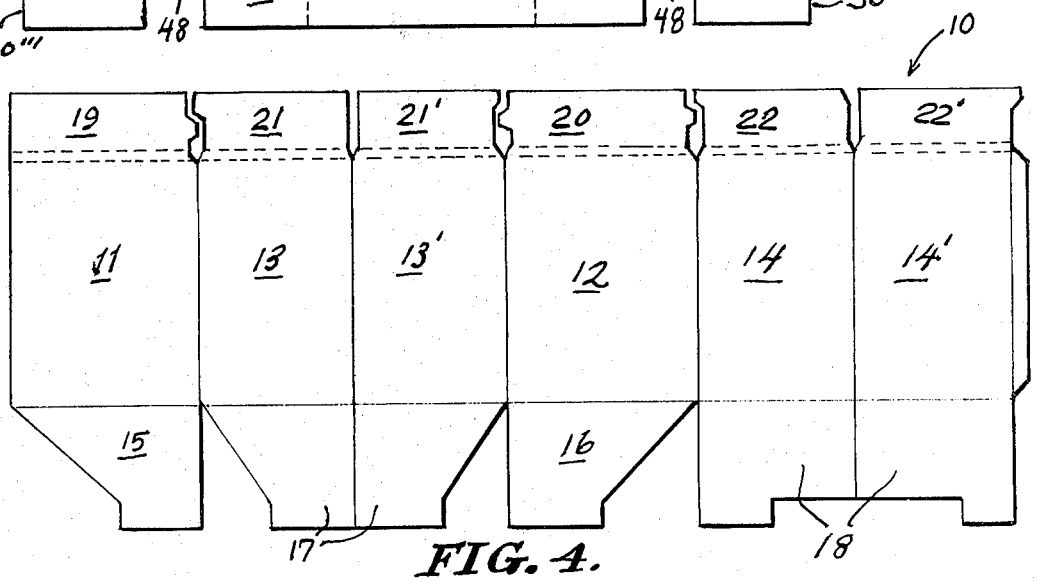
FIG. 4 is a plan view of the single sheet of material from which the file cabinet is formed.

Referring to FIG. 4, wherein there is illustrated the single sheet 10 from which the file cabinet is formed. This sheet by suitable fold lines defines a top wall 11, a bottom wall 12, as well as side walls 13, 13', 14, and 14'. Each of the walls provides rear wall-forming flaps 15, 16, 17, and 18, as well as front edge flaps 19, 20, 21, 21', 22, and 22'. When assembled, the cabinet is generally rectangular in shape and provides an open front.

Figure 1:
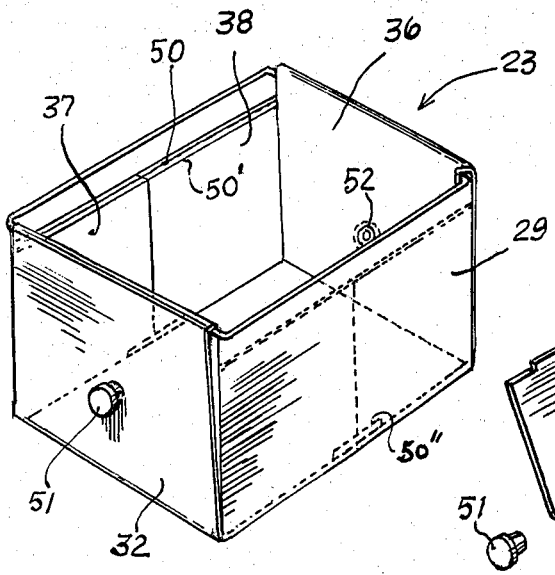
FIG. 1 is a perspective view of the file drawer of this invention.
Figure 3:
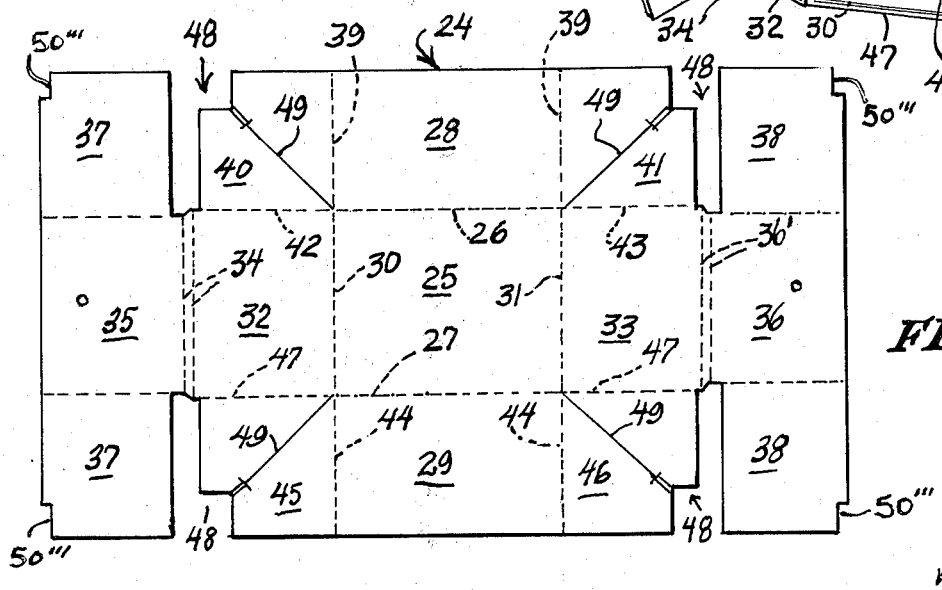
FIG. 3 is a plan view of the single sheet of material from which the file drawer is formed.

Referring to FIG. 1, there is shown a drawer 23, which is adapted to be formed out of the blank of material 24 as shown in FIG. 3.

As viewed in FIG. 3, the blank of material 24 illustrates a bottom wall 25 which by fold lines 26 and 27 are connected to exterior side wall panels 28 and 29. By fold lines 30 and 31 the opposite edges of the bottom wall 25 are connected to outer front wall 32 and rear wall 33.

By a double fold line 34 one edge of the front wall 32 is connected to a front wall insert panel 35.

By like double fold lines 36' one edge of the rear wall 33 is connected to an insert panel 36. To corresponding opposite edges of the insert panels 35 and 36 are connected interior side wall sections 37 and 38, respectively.

Connected to opposite corresponding edges of the side wall panel 28 by fold lines 39 are collapsible flaps 40 and 41. These flaps 40 and 41 by fold lines 42 and 43 are also connected to the outer front wall 32 and rear wall 33, respectively.

To corresponding opposite edges of the side wall 29 by fold lines 44 are connected a second set of collapsible flaps 45 and 46. These collapsible flaps 45 and 46 by fold lines 47 are connected to corresponding opposite edges of the front wall 32 and rear wall 33.

Each of the collapsible flaps 40, 41, 45, and 46 have their outer upper corners notched as at 48 with the remaining portion of such flaps divided into equal sections by diagonal fold lines 49.

In assembly the front and rear walls are identically formed so that the following description of the front wall construction is made applicable to the rear wall of the drawer 23 without further explanation.

Figure 2:
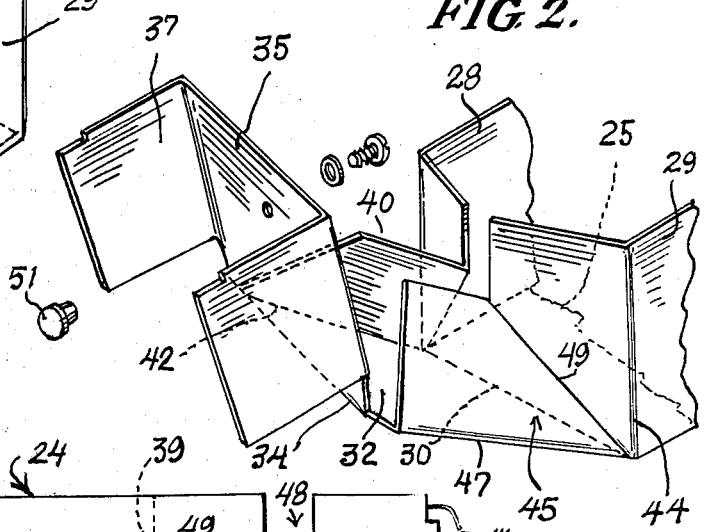
FIG. 2 is a fragmentary perspective view of the front wall of the file cabinet in a distended condition.

As viewed in FIG. 2 the drawer 23 is formed so that the side walls 28 and 29 extend vertically from the bottom wall 25. The collapsible flaps 40 and 45 are folded along their fold lines 39 and 44 out of the plane of the side walls 28 and 29 and along their fold lines 42 and 47 out of the plane of the front wall 32 with the equal sections of the flaps 40 and 45 collapsing inwardly along their diagonal fold lines 49. The insert panel 35 is folded upon its dual fold lines 34 so as to be disposed in a vertical plane behind the collapsible flaps 40 and 45 and between the side walls 28 and 29. The interior side wall sections 37 are then disposed in facial abutment with the interior wall surfaces of the side walls 28 and 29 so as to form an interior side wall for the carton as seen in FIG. 1.

It should be noted that the insert panels 35 and 36 are of a size less than that of the front and rear walls 32 and 33 and that the side wall sections 37 are of a size less than the side walls 28 and 29. Thus, when the drawer 23 is assembled, as shown in FIG. 1, corresponding exposed edges of the side wall sections 37 and 38 will provide an interior shoulder 50 that in turn can be captured in a plastic strip 50', which will support a file carrier when the same is positioned within the drawer 23. The opposite edges of wall sections 37 and 38, adjacent their confronting ends, are notched as at 50''' so as to be captured in a plastic clip 50''.

When the drawer 23 is assembled as heretofore described a drawer pull 51 may be connected to the front wall 32 of the drawer so as to connect it and the insert panel 35 together, while a suitable fastener 52 may be utilized to connect the insert panel 36 in its assembled relation to the rear wall 33.

From the foregoing it is apparent that I have devised a collapsible file cabinet formed from a single sheet of material as well as a file drawer which possesses a multiple layered front and rear wall as well as doubled panelled side walls. It is also apparent that I have provided an interior file carrier support member formed from one of the panels constituting the side walls which will receive suitable file carriers, which are commercially available and which make up no part of the present invention.

While I have illustrated and described the preferred form of construction for carrying my invention into effect, this is capable of variation and modification without departing from the spirit of the invention. I, therefore, do not wish to be limited to the precise details of construction as set forth, but desire to avail myself of such variations and modifications as come within the scope of the appended claims.

Having thus described my invention what I claim as new and desire to protect by Letters Patent is:

1. A file cabinet drawer formed from a sheet of blank material comprising, (a) a drawer having a rectangular shaped bottom wall, (b) exterior side walls connected to opposite side edges of said bottom wall by fold lines, (c) a front and rear wall connected to opposite end edges of said bottom wall by fold lines, (d) corner connecting means between said side walls and said front and rear walls adapted to be folded into facial abutment with the interior surface of said front and rear walls, (e) said corner connecting means including foldable flaps connected to certain end edges of said side walls and said front and rear walls with said flaps divided into equal sections by diagonal fold lines extending therethrough from the junction of certain fold lines of said front and rear walls and adapted to be folded inwardly of the drawer over said front and rear walls, (f) insert means connected to certain end edges of said front and rear walls and foldable inwardly of the drawer over said corner connecting means, (g) means provided by said insert means foldable into facial abutment with the interior surface of said side walls to form interior side wall panels when said flaps are folded inwardly of the drawer, and (h) means provided by said interior side wall panels comprising an exposed straight horizontally extending edge lying in a horizontal plane below the exposed edges of said exterior side walls of said drawer for supporting file carriers thereon within said drawer.

2. A file cabinet drawer as defined by claim 1 wherein said interior side wall panels are of a size less than said exterior side walls and are adapted to be disposed into facial abutment with the interior surfaces of said exterior side walls so as to form double side walls for said drawer.

* * * * *